United States Patent [19]

Hettick, Jr.

[11] Patent Number: 4,529,198

[45] Date of Patent: Jul. 16, 1985

[54] WEIGHT LIFTING APPARATUS

[76] Inventor: Edward K. Hettick, Jr., 2731 Blairstone Rd. #128, Tallahassee, Fla. 32301

[21] Appl. No.: 542,512

[22] Filed: Oct. 17, 1983

[51] Int. Cl.[3] ..... A63B 13/00

[52] U.S. Cl. ..... 272/123; 272/116; 272/117; 272/118

[58] Field of Search ..... 272/123, 122, 93, 116, 272/117, 118, 124; 294/15

[56] References Cited

U.S. PATENT DOCUMENTS 3,612,523 10/1971 Glynn ..... 272/118
3,746,338 7/1973 Proctor ..... 272/118
3,771,785 11/1973 Speyer ..... 272/123
4,361,323 11/1982 Segersten ..... 272/118

FOREIGN PATENT DOCUMENTS 1553143 12/1968 France ..... 272/123

*Primary Examiner*—Richard J. Apley
*Assistant Examiner*—Robert W. Bahr
*Attorney, Agent, or Firm*—Arthur G. Yeager

[57] ABSTRACT

A barbell weight lifting apparatus comprising a plurality of spaced weights in two locations on a stand, a bar, and a weight receiving box on each end of the bar adapted to enclose the spaced weights on the stand when the bar is not in use, a manually operated weight selection scale on each box, and a movable member associated with each scale to automatically attach to each box the selected weights.

20 Claims, 6 Drawing Figures

Fig. 4
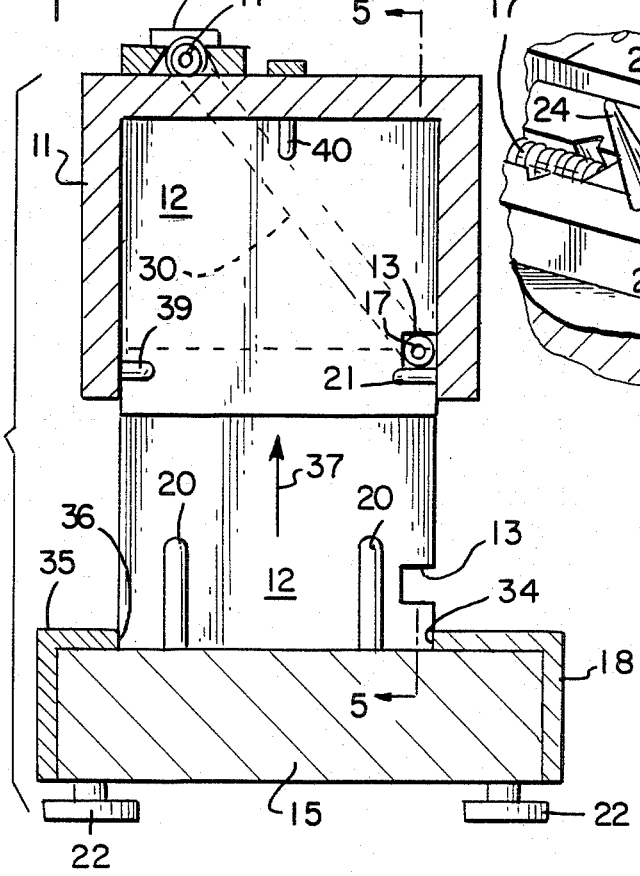
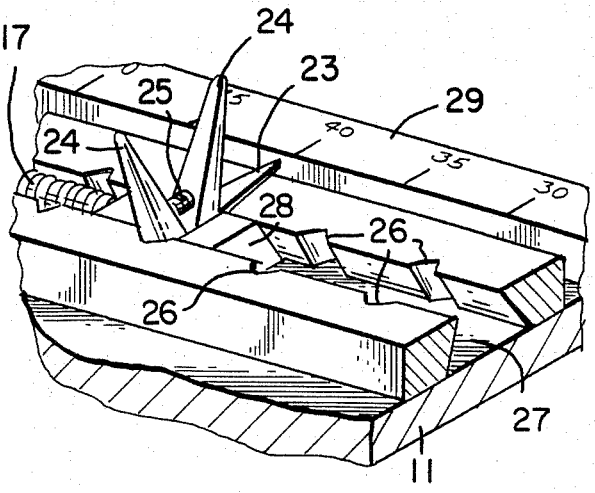
Fig. 6
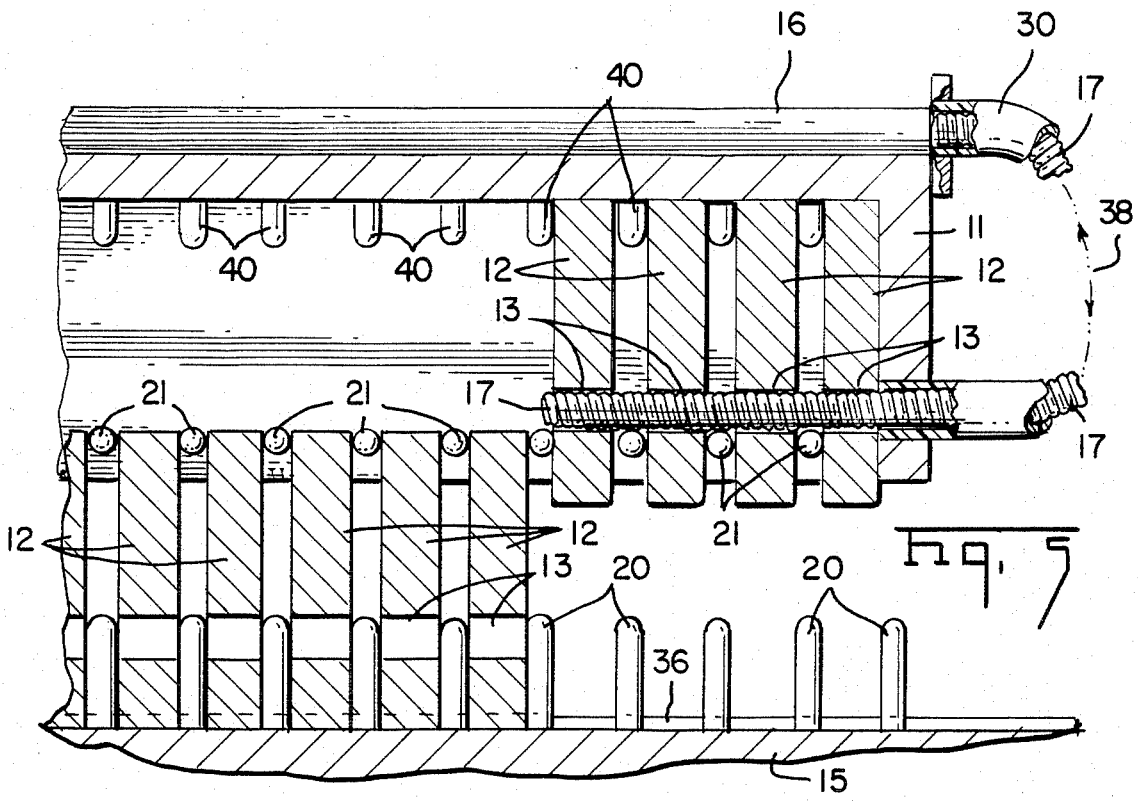
Fig. 5

WEIGHT LIFTING APPARATUS

BACKGROUND OF THE INVENTION

Barbell weight lifting apparatus normally consists of a bar, a plurality of discs of various weights with a central hole to permit each disc to slide onto the end of the bar, and two pairs of collars that are locked onto the bar to hold each set of disc weights in position at the ends of the bar. The selection of the appropriate weights and the assemblage of those weights on the bar is a time consuming delay, and the lack of any organized storage rack for miscellaneous weights lying around in disarray results in an eyesore. Attempts in the prior art to improve upon this system have either taken the form of designing specially formed weights (e.g. U.S. Pat. No. 3,771,785) or incorporating the device into a large machine involving pulleys or levers (e.g. U.S. Pat. No. Re. 31,113, U.S. Pat. Nos. 3,746,338 and 4,361,323). None of these improvements provides the desired facility of adjustment and yet retains the simplicity of a barbell device.

It is an object of this invention to provide an improved barbell weight lifting device. It is another object of this invention to provide a simple barbell device with an automatically adjustable weight selection. Still other objects will be apparent from the more detailed description of this invention which follows.

BRIEF DESCRIPTION OF THE INVENTION

A barbell weight lifting apparatus comprising a lifting bar attached to at least one weight containing box having an open side for the passage of weights therethrough, and a plurality of plate-like weights housed in said box, selective means connected to said box to releasably secure a selected number of weights to said box, the remaining nonselected weights passing through said open side when the lifting bar and box are lifted from said plurality of weights.

In a preferred embodiment the lifting bar has a identical weight containing box on each end thereof, and a receiving stand on which the lifting bar rests when not in use has two spaced storage units for storing a plurality of weights standing on edge and aligned lengthwise of the storage unit.

In a specific embodiment the weights are rectangular plates and the box at each end of the bar is rectangular with internal receptacles which fit closely over the weights on the receiving stand, each weight having a notch adapted to receive a sliding coil spring attached to a sliding weight selection indicator.

BRIEF DESCRIPTION OF THE DRAWINGS

The novel features believed to be characteristic of this invention are set forth with particularity in the appended claims. The invention itself, however, both as to its organication and method of operation, together with further objects and advantages thereof, may best be understood by reference to the following description taken in connection with the accompanying drawings in which:

FIG. 4 is a cross-sectional view taken at 3—3 of FIG. 1, but the weight receiving box lifted above the receiving stand.

FIG. 5 is a cross-sectional view taken at 5—5 of FIG. 4.

FIG. 6 is an enlarged prospective view, partially in cross-section, of the weight indicating portion of this apparatus.

DETAILED DESCRIPTION OF THE INVENTION

Figure 1:
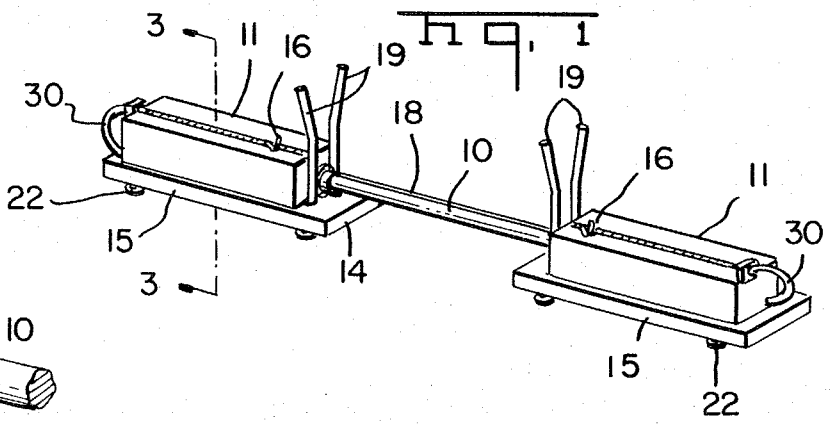
FIG. 1 is a perspective view of the apparatus of this invention.
Figure 3:
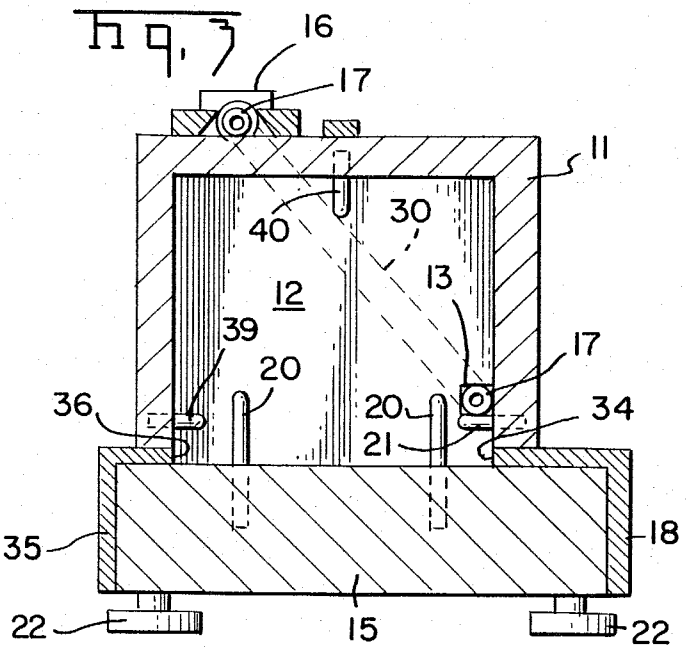
FIG. 3 is a cross-sectional view taken at 3—3 of FIG. 1.

The general features of this invention may be seen in FIG. 1 showing the apparatus at rest and ready for use by a weight lifter. The apparatus comprises a bar 10 having at each end thereof a weight containing box 11, and a receiving stand 14. On top of each weight receiving box 11 is a weight selection device 16 which moves a sliding coil spring housed in tubular conduit 30 to attach the selected number of weights to box 11. This attachment means as well as the weight selection device are described below in greater detail. The receiving stand 14 comprises two weight storage members 15 spaced apart from each other by spacer bar 18. Each storage member 15 also contains a pair of upstanding guide rods 19 which serve to guide the ends of bar 10 and weight containing boxes 11 to the proper location when being returned to the position at rest.

Figure 2:
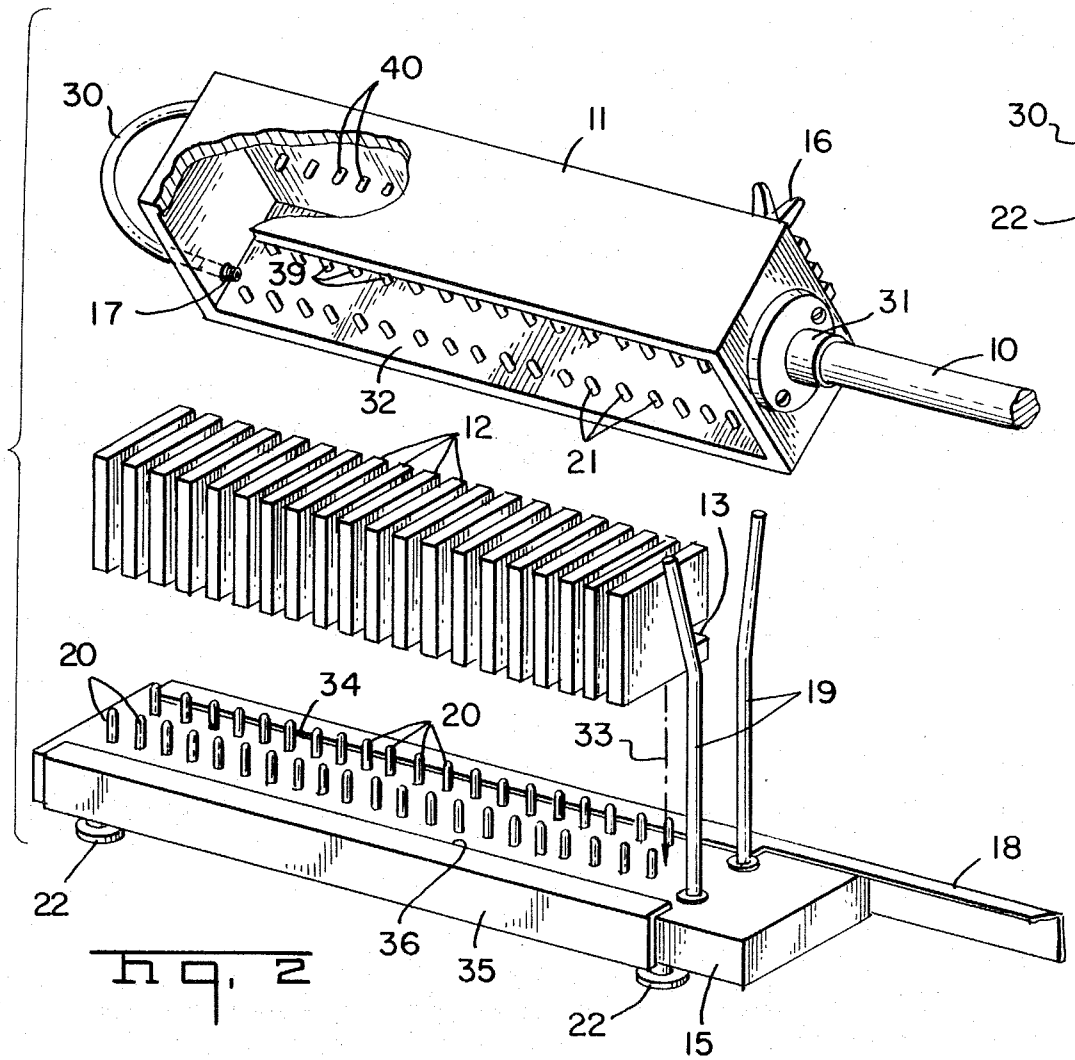
FIG. 2 is an exploded view of one portion of the apparatus of this invention.

The intimate details of the weight storage and usage system are best seen in FIG. 2 wherein weights 12 are shown suspended above storage member 15, and weight receiving box 11 suspended above weights 12. If weights 12 are moved downwardly in the direction of arrow 33 until they rest on storage member 15, and weight receiving box is moved downwardly over weights 12 until it comes to rest, the combination would look as it is shown in FIG. 1.

Weight storage member 15 is one of two identical (mirror image) components affixed rigidly to spacer bar 18. Storage member 15 has two parallel rows of pegs 20 projecting upwardly from its upper surface. Pegs 20 are spaced apart from adjacent pegs in the same row by an amount equal to the thickness of one weight 12. Pegs 20 in one row are aligned with respective pegs 20 in the other row so that two pegs 20 are between each adjacent pair of weights 12. In the embodiment shown here there are twenty weights of two and one-half pounds each to provide a selection of weights to be added to the basic structure of the weight lifting apparatus in five-pound increments up to one hundred pounds if the two ends of the apparatus are balanced. Projecting upwardly from member 15 are two guide rods 19 tapering so as to receive the ends of bar 10 and guide them so that box 11, weights 12, and storage member 15 will mesh accurately. Feet 22, which may be adjustable for levelling purposes, are attached to the bottom of storage member 15.

When weights are stored on member 15, they stand on edge, aligned with each other, and spaced apart as shown in FIG. 2. Pegs 20 have been described as maintaining the proper spacing between adjacent weights 12. The alignment of weights 12 is accomplished by parallel aligning edges 34 and 36. These edges may be formed by two L-shaped edge covers 18 and 36. Spacer bar 18 which maintains the two storage members 15 in the proper spacing from each other is merely extended to form edge 34. L-shaped cover 35 is applied to the opposite edge of storage member 15 to provide aligning edge 36. The distance between edges 34 and 36 is slightly greater than the length of the bottom edge of weight 12. It is clear that cover 35 and spacer bar 18 may each be a commercially available piece made of iron, steel, copper, brass, or aluminum. Other methods of forming edges 34 and 36 are equally acceptable.

Weight containing box 11 is of a size and shape to be placed over all of weights 12 when standing on edge, spaced and aligned as described above. Thus, box 11 has an open bottom side 32, i.e. the side that is placed over the top of the plurality of weights 12. All other sides of box 11 are preferably closed around weights 12. Each of the three sides of box 11 on the inside surface thereof, has a row of pegs projecting inwardly therefrom. Pegs 21 are on the back side of box 11; pegs 39 are on the front side of box 11; and pegs 40 are on the top of box 11. All pegs are spaced so as to receive one weight between adjacent pegs in the same row, and the pegs in the three rows are positioned so that between adjacent weights there are three pegs (one from each of rows 21, 39 and 40) to maintain the weights in the same spaced relationship as they are on storage member 15. The inside dimensions of box 11 are only slightly larger than the outside dimensions of weights 12 so that box 11 will easily be placed over the top of the aligned weights 12 and yet weights 12 which are inside box 11 will have a minimum of tolerance and fit as snugly as possible inside box 11.

Each weight is held in box 11 by a sliding retainer which is connected to a manually operated weight selection and indicating device. In the embodiment shown in these drawings the sliding retainer is a length of a small diameter coil spring 17. Spring 17 is mated with notches 13 on weights 12. In this embodiment each weight 12 has a square notch 13 in the lower portion of the back side of weight 12. The dimensions of notch 13 are such that spring 17 readily slides through the notch although the tolerances are relatively close. For example, spring 17 might be one-half inch in diameter and the corresponding notch 13 would be nine-sixteenths to five-eighths inch on a side. Notches are positioned such that the bottom of notch 13 is aligned with the tops of pegs 21.

One end of spring 17 is directly attached to a sliding weight selection device 16 and the other end of spring 17 is at the appropriate location in the groove formed by aligned notches 13. The weight selection device is placed on the top outside of box 11 where it can easily be seen and manipulated. The groove formed by notches 13 is on the lower back side of box 11 where it functions best to hold spring 17 for supporting weights 12 in box 11. In order for spring 17 to be a single length of spring and to slide smoothly in both directions 38 there is a connecting tubular conduit 30 which guides spring 17 from the outer end of its connection to weight selection device 16 to the outer end of the groove formed by notches 13.

Weight selection device 16 is best seen in detail in FIG. 6 showing a trapezoidal-shaped dovetail groove 27 and a follower 28 slidingly engaged in groove 27 with spring 17 firmly affixed to follower 28. Attached to follower 28 and projecting forwardly therefrom is pointer 23 which moves along fixed scale 29. Groove 27 is fashioned with notches 26 on one or both sides of groove 37 as desired. Notches 26 are mated with an appropriate plunger or plungers (not shown) which are spring loaded to push the plunger outward into notch 26 and thereby hold follower 28 in a fixed position. Manual finger grips 24 are squeezed together against spring 25 to release the plungers from notches 26 and to permit movement of pointer 23 to whatever weight is selected on scale 29. Notches 26 are coordinated with pointer 23, scale 29, and the distance between adjacent pegs 21, so that by moving pointer one increment of weight there will be a notch 26 to hold pointer 23 and follower 28 in the selected position and the other end of spring 17 will move from one peg 21 to the next adjacent peg 21. In the preferred embodiment of this invention each weight 12 weighs two and one-half pounds, and the total weight of bar 10 and boxes 11 containing no weights is twenty pounds. With twenty weights 12 on each storage member 15, the apparatus of this invention provides a range of twenty to one hundred twenty pounds in five-pound increments (if an equal number of weights is always employed in each box 11). Thus, scale 29 is shown in FIG. 6 to be marked in five-pound increments. Movement of pointer 23 from, for example, thirty-five to forty pounds is sufficient to move spring 17 (in FIG. 5) from a position holding three weights to the position shown in the drawing holding four weights. It may be seen that with spring 17 resting on the tops of pegs 21 and engaged in notches 13, weights 12 are held securely in box 11 when it is lifted in the direction of arrow 37 (FIG. 4).

It is intended that this invention be considered to embrace other embodiments and alternative devices. For example, spring 17 could be replaced by a flexible band or strip. Furthermore, there are alternative ways for holding weights 12 in box 11. They might be supported by passing spring through holes in the tops of weights 12, or by a rigid support at the bottom, eliminating any need for notches 13. Pegs 20, 21, 39 and 40 can be replaced by grooves for individual weights, or by other spacer members. Weights 12 may be attached to or detached from box 11 by hook or lever means operated individually for each weight or collectively for several weights. Weights 12, boxes 11, and storage members 15 may be designed in different ways to accommodate different shapes of weights 12. It is, however, the central theme of this invention to employ a plurality of weights on a storage member 15 which can be quickly attached to box 11 in the amount desired and thereby provide a weight lifting bar bell apparatus that does not require the tedious attachment of separate weights to each end of a bar followed by clamping them in place.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A barbell weight lifting apparatus comprising a lifting bar attached to at least one box having an open side for the passage of weights therethrough, a plurality of plate-like weights housed in said box, selective means connected to said box to releasably secure a selected number of weights to said box, the remaining nonselected weights passing through said open side when said lifting bar and box are lifted.

2. The apparatus of claim 1 wherein said bar has one said box at each end thereof.

3. The apparatus of claim 1 which additionally comprises a receiving stand with said weights arranged thereon to pass through said open side when said bar and box are lowered from a lifted position to a position resting on said receiving stand.

4. The apparatus of claim 3 wherein said weights on said receiving stand are spaced apart from each other and stand on edge in an aligned arrangement.

5. The apparatus of claim 1 wherein said selective means comprises a notch through each said weight and a sliding member adapted to slide through said notch.

6. A barbell weight lifting apparatus comprising a bar having a weight containing box at each end thereof, a barbell receiving stand, and a plurality of identical plate-like weights, said receiving stand having two spaced storage members for storing a plurality of said weights standing on edge, said weight containing box having a plurality of spaced receptacles each having an open side to pass one of said weights therethrough, and a weight selection indicator on said box cooperating with means to attach the selected weights to said box.

7. The apparatus of claim 6 wherein said box is enclosed on all sides except the bottom which is adapted to be placed over the upstanding weights on said receiving stand.

8. The apparatus of claim 6 wherein said weight selection indicator operates sliding lengthwise along said box and cooperates with a sliding weight supporting member adapted to attach selected weights to said box.

9. The apparatus of claim 6 wherein said receiving stand additionally includes guide members to guide said weight containing boxes into mesh with said spaced weights on said storage members.

10. The apparatus of claim 6 wherein each said storage member weight is spaced from its adjacent weight by a pair of pegs upstanding from the upper surface of a flat base member on which said weights rest on edge, and said upper surface being grooved to receive the edges of the weights resting thereon in an aligned relationship.

11. The apparatus of claim 10 wherein said weight containing box contains a plurality of spacing pegs to space each said weight in said box from its adjacent weight.

12. The apparatus of claim 8 wherein said weight supporting member is a flexible coil spring attached at one end to a pointer sliding along a linear scale indicating different amounts of total weight, and the other end of said spring slides through notches in the selected weights.

13. A barbell weight lifting apparatus comprising a bar having a weight containing box at each end thereof, a barbell receiving stand, and a plurality of identical plate-like weights each having an identically positioned notch in the parimeter thereof, said receiving stand having two spaced storage members for storing a plurality of said weights standing on edge and arranged in spaced aligned, said weight containing box having an open side and having spaced receptacles to receive said spaced weights therein as said box is moved downwardly over said plurality of stored weights, a sliding weight selection indicator on said box, and a sliding coil spring attached to said indicator and adapted to slide with a close tolerance through said notches.

14. The apparatus of claim 13 wherein said weights are rectangular plates and said box is rectangular.

15. The apparatus of claim 14 wherein said box is enclosed on all sides except the bottom which is adapted to be placed over the upstanding weights on said receiving stand.

16. The apparatus of claim 13 wherein said receiving stand additionally includes guide members to guide said weight containing boxes into mesh with said spaced weights on said storage members.

17. The apparatus of claim 13 wherein said storage member has a flat horizontal surface with spaced lateral pairs of pegs upstanding thereon and two parallel lengthwise edge guides thereon, arranged to receive said plurality of weights in said spaced alignment.

18. The apparatus of claim 17 wherein said weight containing box contains a plurality of spacing pegs arranged to produce a spaced alignment identical to that of said storage member.

19. The apparatus of claim 13 wherein said coil spring is attached at one end to a pointer sliding along a linear scale indicating different amounts of total weight, and with the other end sliding through said identically positioned notches of the selected number of spaced weights in said weight containing box, said box having a smoothly curved tubular conduit to guide said coil spring from said indicator to said notches.

20. The apparatus of claim 13 wherein each said box includes spacer and support means extending inwardly of said box and positioned adjacent the bottom of said notches for supporting said coil spring and said weights engaged by said coil spring.

* * * * *